US010836604B2

(12) United States Patent
Bünter et al.

(10) Patent No.: US 10,836,604 B2
(45) Date of Patent: Nov. 17, 2020

(54) METHOD AND SYSTEM FOR OPERATING ELEVATOR INSTALLATION USING MOBILE RADIO

(71) Applicant: Inventio AG, Hergiswil (CH)

(72) Inventors: Adrian Bünter, Giswil (CH); Markus Gilli, Sempach (CH)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 15/117,465

(22) PCT Filed: Feb. 11, 2015

(86) PCT No.: PCT/EP2015/052853
§ 371 (c)(1),
(2) Date: Aug. 9, 2016

(87) PCT Pub. No.: WO2015/121294
PCT Pub. Date: Aug. 20, 2015

(65) Prior Publication Data

US 2016/0376124 A1 Dec. 29, 2016

(30) Foreign Application Priority Data

Feb. 13, 2014 (EP) ..... 14155095

(51) Int. Cl.
*B66B 1/34* (2006.01)
*B66B 1/46* (2006.01)

(52) U.S. Cl.
CPC ..... *B66B 1/468* (2013.01); *B66B 2201/4615* (2013.01); *B66B 2201/4653* (2013.01); *B66B 2201/4676* (2013.01)

(58) Field of Classification Search
USPC ..... 187/247
See application file for complete search history.

(56) References Cited

U.S. PATENT DOCUMENTS

| | | | | |
|---|---|---|---|---|
| 6,223,160 | B1 * | 4/2001 | Kostka | B66B 1/468 187/380 |
| 6,868,945 | B2 | 3/2005 | Schuster et al. | |
| 7,347,303 | B2 * | 3/2008 | Kontturi | B66B 1/468 187/380 |
| 8,032,239 | B2 * | 10/2011 | Brissman | G08C 19/00 700/292 |
| 2003/0159890 | A1 | 8/2003 | Schuster et al. | |
| 2006/0144644 | A1 * | 7/2006 | Chiba | B66B 1/34 187/380 |

(Continued)

FOREIGN PATENT DOCUMENTS

| | | | |
|---|---|---|---|
| CN | 1427799 | A | 7/2003 |
| CN | 1774381 | A | 5/2006 |

(Continued)

*Primary Examiner* — Christopher Uhlir
(74) *Attorney, Agent, or Firm* — William J. Clemens; Shumaker, Loop & Kendrick, LLP

(57) ABSTRACT

A method for operating an elevator installation, the installation including an elevator control device, uses a mobile radio to perform operator control actions for the elevator installation. The mobile radio receives relevant data allowing indirect access to the elevator installation initially in the form of an identification code that is transmitted continuously or regularly by a transmission unit associated with the elevator installation.

16 Claims, 7 Drawing Sheets

(56) References Cited

U.S. PATENT DOCUMENTS

| | | | | |
|---|---|---|---|---|
| 2007/0131487 | A1 | 6/2007 | Kontturi et al. | |
| 2009/0020370 | A1* | 1/2009 | Boss | B66B 1/468 187/247 |
| 2011/0120814 | A1* | 5/2011 | Schuster | B66B 1/34 187/389 |
| 2012/0000733 | A1* | 1/2012 | Finschi | B66B 1/2458 187/382 |

FOREIGN PATENT DOCUMENTS

| | | | |
|---|---|---|---|
| CN | 202602625 | U | 12/2012 |
| EP | 1749775 | A1 | 2/2007 |
| WO | 200600618 | A2 | 1/2006 |
| WO | 2006005789 | A2 | 1/2006 |
| WO | 2014116182 | A1 | 7/2014 |
| WO | 2015/121294 | A1 | 8/2015 |

* cited by examiner

32 ELEVATOR INSTALLATION IDENTIFIER
34 FLOOR NUMBER
36 ELEVATOR NUMBER
38 TYPE OF CONTROL

44 IDENTIFICATION CODE PREFIX
46 ELEVATOR INSTALLATION IDENTIFIER
48 FLOOR DESIGNATOR
50 MESSAGE AUTHENTICATION CODE

METHOD AND SYSTEM FOR OPERATING ELEVATOR INSTALLATION USING MOBILE RADIO

FIELD

The invention relates primarily to a method of operating an elevator installation. Moreover, the invention also relates to an elevator control device as well as to a mobile radio for carrying out the method and to a system with such an elevator control device and such a mobile radio. Finally, the invention also relates to a computer program for implementation of the method as well as a computer program product with such a computer program and a device—in particular, for example, the elevator control device as well as the mobile radio—with such a computer program as means for carrying out the method.

BACKGROUND

The operation of an elevator installation by means of an elevator control device is known in its essential features. If a user would like to travel from one floor (starting floor) to another floor (destination floor) the user actuates on the respective starting floor a control panel associated with the elevator installation and thus generates a so-called floor call which is processed by the elevator control device. If the elevator car or an elevator car of the elevator installation is available or without specific limitations is compatible, in the current movement process, with the floor at which the floor call was triggered the elevator control device causes movement of the elevator car to and/or stopping of the car at the respective floor. When the user boards the elevator car, the user selects a destination floor at a control panel in the elevator car and thus triggers a car call at the elevator control device. The elevator car is subsequently moved to the thus-specified destination floor. In that case, optionally there is movement to previously specified other destination floors or the elevator car stops, due to a car call or floor call, at a floor between the current floor and the destination floor.

Mobile radios in the form of so-called smartphones and the like enjoy an increasingly wider user circle and users of such mobile radios are accustomed to being able to obtain additional data by their own mobile radio via the mobile telephone system or to be able to control other apparatus by the mobile radio.

SUMMARY

Accordingly, an object of the present invention is to indicate a possibility of use of mobile radios in connection with the utilization of an elevator installation.

This object is fulfilled by a method of operating an elevator installation with the features described herein. In the method according to the invention it is provided that at least one respective transmitter unit is present in each of a number of floors reachable by the elevator installation and that each transmitter unit transmits a floor-specific identification code, particularly a floor-specific and elevator-installation-specific identification code. The use of such an identification code is carried out in such a way in the context of the method that the identification code is received by means of a mobile radio, that a travel wish is specified by means of a software application running on the mobile radio, that the travel wish is communicated in the form of a first travel request transmission to a remote server, particularly a server reachable in the internet, with use of the floor-specific identification code or optionally with use of the floor-specific and elevator-installation-specific identification code, and that the server passes on the travel wish in the form of a second travel request transmission to the elevator installation. The mobile radio and the software application running thereon, particularly a user interface represented by means of the software application, in that case function like a conventional control panel of the elevator installation, in particular, for example, like a conventional floor control panel. The travel request transmission belonging to the travel wish specified by the mobile radio and to the software application running thereon is generated by the software application with use of the floor-specific or floor-specific and elevator-installation-specific identification code. Because the identification code is at least floor specific, the travel request transmission comprises data with respect to the floor at which the user of the mobile radio will commence use of the elevator installation. Communication of the travel wish by the server to the elevator installation is carried out, for example, at an elevator control device of the respective elevator installation or at a unit functioning as an interface relative to the elevator control device.

The advantage of the invention consists in that the mobile radio with a software application running thereon and intended for execution of the method can be used in place of usual control panels of the elevator installation and in that case additional functions and/or data are available. Thus, the user of the mobile radio does not, for example, specify the respective starting floor for his or her travel wish, since data with respect to the starting floor are already included in the floor-specific identification code received by a transmitter unit. Erroneous inputs are in this way prevented.

In one form of embodiment of the method the identification code comprises at least an elevator installation identifier and the elevator installation transmits to the remote server an elevator installation data set which comprises elevator-installation-specific data, namely similarly at least one elevator installation identifier. The software application of the mobile radio transmits a respectively received identification code or at least the elevator installation identifier included therein to the server. The server on receipt of the elevator installation identifier searches for an elevator installation data set with a matching elevator installation identifier. In the event of success, thus if an elevator installation data set matching the received elevator installation identifier could be ascertained, the server transmits the elevator installation data set to the mobile radio.

The mobile radio and the software application running thereon thus receive the elevator-installation-specific data comprised in the elevator installation data set, such as, for example, the number of the floors reachable by the elevator installation. Due to the fact that prior to communication of the elevator installation data set to the mobile radio the elevator installation identifier of the identification code is evaluated it can be ensured that only those elevator-specific data matching the elevator installation in that building in which the user with his or her mobile radio is currently present are passed to the mobile radio.

In an advantageous form of embodiment of the method at least individual items of the data included in the identification code and/or the elevator installation data set are represented graphically or in other mode and manner by means of a user interface generated by the software application. Because the identification code is floor-specific, the user of the mobile radio can in the case of representation of the data included in the identification code be informed about, for example, the floor on which he or she is currently present in the building concerned. By virtue of the elevator-installation-specific data of the elevator installation data set it is possible to realize a display of the floors reachable by the elevator installation and/or a display of further data concerning the respective building.

If the identification code comprises an identification code prefix the server receiving the identification code can distinguish data transmissions, which include the identification code prefix, from other data transmissions by means of the identification code prefix.

If the identification code comprises a transmission authentication code or message authentication code, particularly a transmission or message authentication code in the form of a coded hash message authentication code, it can be ensured that the identification code or a data telegram with the identification code was not falsified en route to the server, so that misuse is excluded.

The above-mentioned object is also fulfilled by an elevator control device as well as a mobile radio, which are intended and arranged for carrying out the part of the method on the elevator installation side or mobile radio side. The invention is that case preferably implemented in software. The invention is thus on the one hand also a computer program with program code instructions executable by a computer and on the other hand a storage medium with a computer program of that kind, thus a computer program product with program code means, as well as finally also an elevator control device and a mobile radio, in the memory of which such a computer program is loaded or loadable as means for carrying out the method and its embodiments.

The above-mentioned object is similarly fulfilled by means of a system which comprises such an elevator control device and such a mobile radio as well as a plurality of radio units and an external server, wherein the individual units of the system are characterized by the features described here and in the following, particularly in that in co-operation with other units of the system they allow performance of the method in correspondence with the approach proposed here and in operation execute such a method.

An embodiment of the invention is explained in more detail in the following by way of the drawings. Subjects or elements corresponding with one another are provided in all figures with the same reference numerals.

The or each embodiment is not to be understood as restricting the invention. Rather, enhancements and modifications are entirely possible within the scope of the present disclosure, particularly such which, for example, are inferrable by the expert with respect to fulfillment of the object through combination or modification of individual features or method steps described in connection with the general or specific part of the description as well as present in the claims and/or the drawing and which through combinable features lead to a new subject or to new method steps or method step sequences.

DETAILED DESCRIPTION

Figure 1:
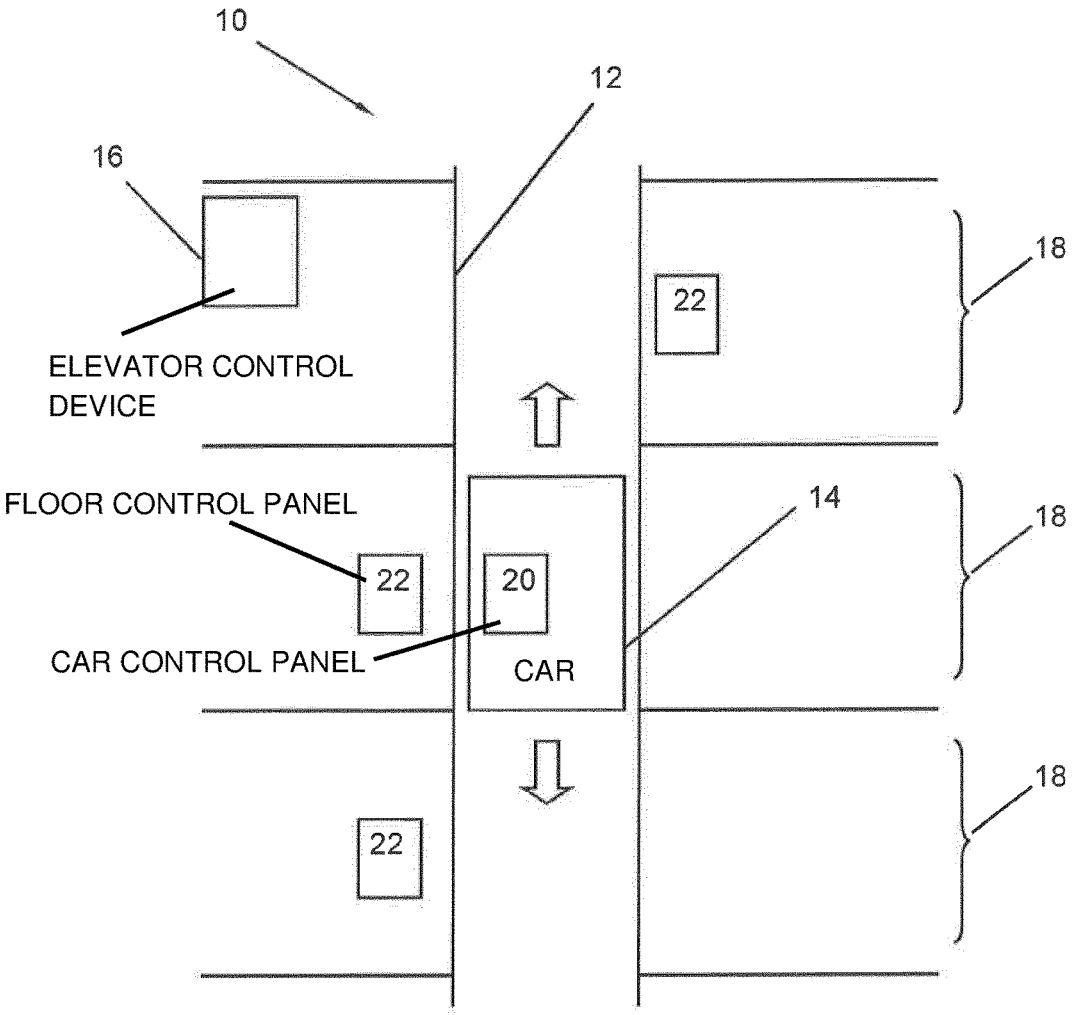
Fig. 1 (Prior Art)
FIG. 1 shows an elevator installation with an elevator control device according to the prior art.

The illustration in FIG. 1 shows schematically and in simplified form an elevator installation 10 in a building, which is not itself shown, with at least one elevator car 14 movable in at least one elevator shaft 12 and an elevator control device 16 provided at a central point of the building. The elevator control device 16 is provided in a mode and manner known per se for control of the elevator installation 10. The or each elevator car 14 is movable in a mode and manner known per se in the elevator shaft 12 or in the respective elevator shaft 12 so that different floors 18 of the building are reachable.

Different control panels 20, 22, namely at least one car control panel 20 as well as a respective control panel on each floor 18 (floor control panel 22), are usually provided for a user of the elevator installation 10. The user of the elevator installation 10 communicates a respective travel request to the elevator control device 16 in the course of control actions at a control panel 20, 22 and, as soon as the travel request can be fulfilled, the elevator control device 16 causes corresponding movement of the elevator car 14.

Figure 2:
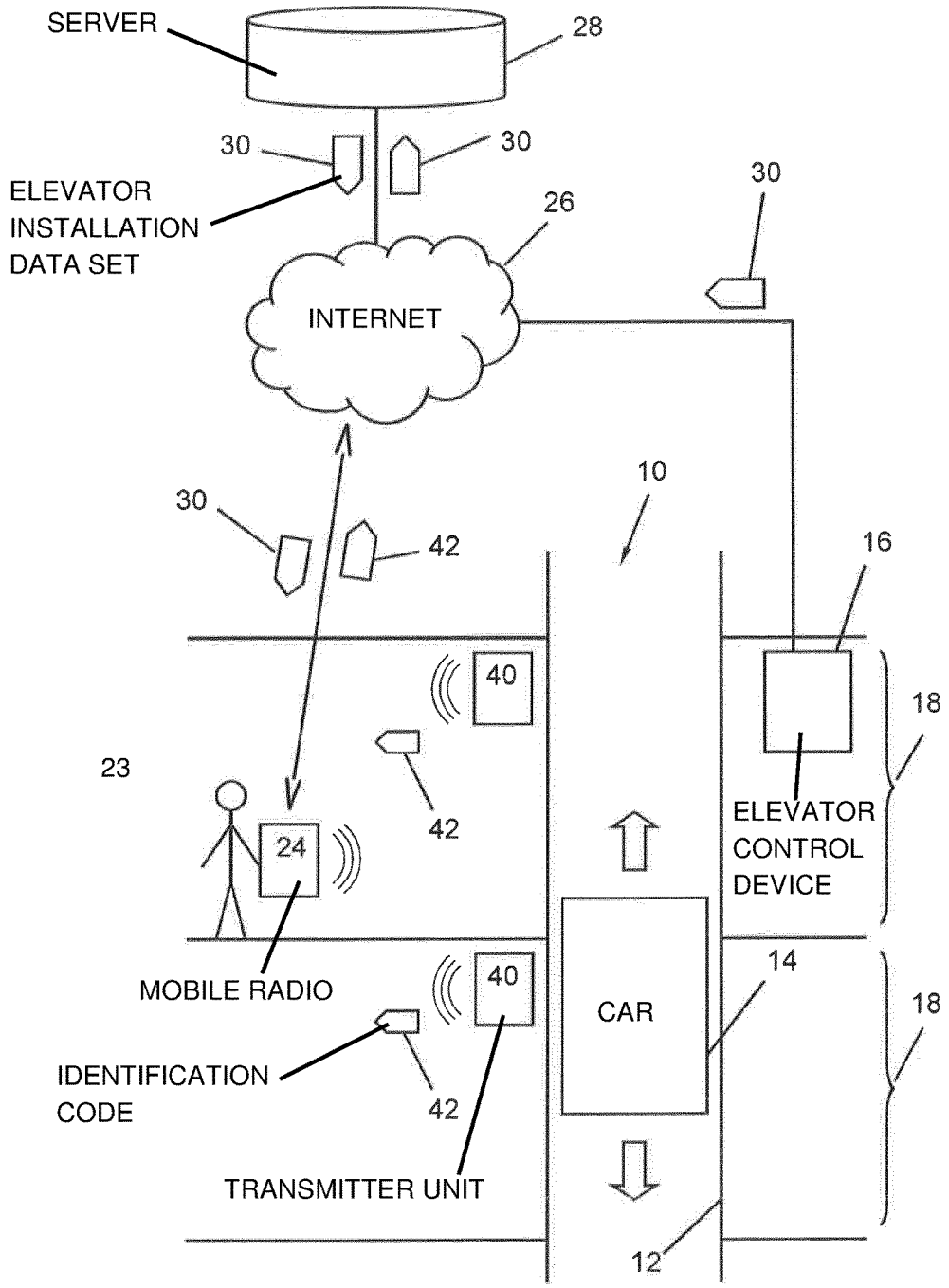
FIG. 2 shows the elevator installation as in FIG. 1 with transmitter units mounted in floors reachable by the elevator installation as well as a schematic simplified illustration of communications procedures taking place within the scope of the method presented here.

With the increasing spread of mobile radios of all kinds, particularly so-called smartphones, netbooks, tablet computers, etc., which in the following are termed mobile radios in summary and without waiver of a wider generality, there is a wish for a user of an elevator installation 10 to be able to trigger floor and car calls even without use of 'normal' control panels 20, 22 and instead thereof by means of his or her mobile radio 24 (FIG. 2).

The illustration in FIG. 2 repeats, for further description of the approach proposed here, individual aspects of the illustration in FIG. 1, so that these do not have to be described again here. The number of depicted floors 18 has been reduced in the illustration in FIG. 2 by comparison with the illustration in FIG. 1 only for reasons of clarity. In fact, the approach proposed here is not restricted to an elevator installation 10 with a specific number of floors 18. Moreover, the approach proposed here is usable even in the case of an elevator installation 10 with several elevator cars 14.

Shown in the illustration in FIG. 2 is a person 23 who is designated here and in the following as "user" and who wishes to use an elevator car 14 of the elevator installation 10 to go from a starting floor to a destination floor. The user 23 carries a mobile telephone 24. The mobile telephone 24 is connectible in terms of communication in a mode and manner known per se with a mobile radio network as well as the internet 26 and is so connected in the case of use in the context of the approach proposed here. A connection with an external server 28, for example a server 28 of the manufacturer or the operator of the elevator installation 10, can be produced by way of the internet 26.

The elevator control device 16 or a further device (not shown) connected by a line or without a line with the elevator control device 16 at the location of the elevator installation 10 is itself connected by a line or without a line with the internet 26 and by way of the internet 26 with the server 28. The following description is continued, without waiver of a wider generality, by way of the example of an elevator control device 16 connected directly with the server 28 by way of the internet 26, thus without interposition of a further device. The possibility of interposition of such a device is, however, always to be read into the following. Insofar as such a unit is present, in the case of the method hereinafter described it is present in part at the place of the elevator control device 16. The following possibilities, in particular, can be considered for the non-wired or wired connection with the internet 26: LAN, WLAN/WiFi, PSTN, 2G, 3G, LTE, GPRS, etc.

After placing the elevator installation 10 in operation, at the conclusion of maintenance of the elevator installation 10 or in accordance with additional or alternative predetermined or predeterminable rules (once per day, once per month, in the event of disruptions, in the event of exchange of components, etc.) the elevator control device 16 transmits to the server 28 an elevator installation data set 30 which describes the elevator installation 10, in a data telegram (termed telegram for short in the following). The elevator installation data set 30 is stored on the side of the server 28 in a database (not shown separately) provided for that purpose and can be called up at the server 28 from this database.

Figure 3:
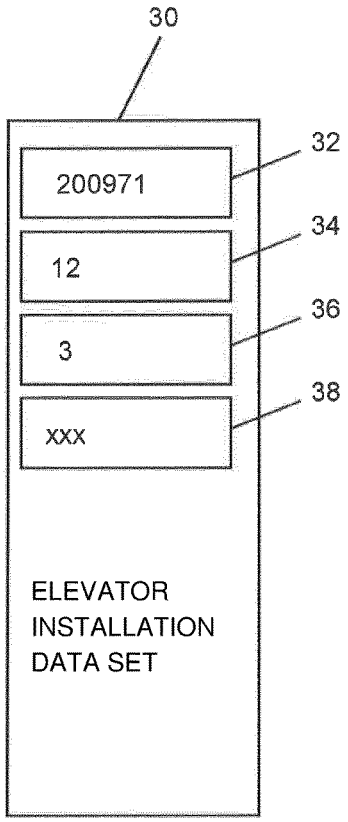
FIGS. 3, 4 show one possible layout of two data transmissions communicated in the context of the communications procedures shown in FIG. 2, namely an elevator installation data set and an identification code transmitted by a transmitter unit.

The illustration in FIG. 3 shows one possible layout of the elevator installation data set 30 and individual items of data included in the elevator installation data set 30 in correspondence with the approach proposed here. Belonging to these data is an elevator installation identifier 32, which uniquely identifies the respective elevator installation 10 and which is indicated in FIG. 3 symbolically and by way of example as '200971'. The data additionally included in the elevator installation data set 30 describe the elevator installation 10 by further details. To that extent, belonging to the data are a statement about the numbers of the floors 18 (floor number 34), a statement about the numbers of the elevator cars 14 (elevator number 36) and a coded statement about the kind of control (control type 38). The control type 38 encodes whether the respective functionality of the elevator control device 16 is a conventional control, a group control, a destination call control or a control with special functions. Special functions can be functions with access control possibilities as well as additionally or alternatively execution of a travel request appropriate to a handicapped person or an implementation which facilitates boarding by mothers or users with child carriages, shopping trolleys, etc., and which provides for that purpose a longer opening time of the car and floor doors.

The elevator control device 16 in every instance transmits an elevator installation data set 30 with an elevator installation identifier 32 to the server 28. The respective elevator installation 10 is then known on the side of the server 28 and use of the elevator installation 10 is possible within the scope of the concept proposed here. The elevator control device 16 can transmit the above-mentioned further elevator-installation-specific data 34, 36, 38 together with the elevator installation identifier 32 in the elevator installation data set 30. Alternatively, there is also the possibility of the elevator control device 16 transmitting these elevator-installation-specific data 34, 36, 38 to the server 28 only when a request is made by the server 28 at the elevator control device 16.

The interaction with the elevator installation 10, namely the elevator control device 16, by means of the mobile radio 24 in correspondence with the approach proposed here is described in the following:

Transmitter units 40 (FIG. 2) at each floor 18, or at least at those floors 18 at which the approach described here is to be usable, belong to the elevator installation 10. At least one transmitter unit 40 is present on each floor 18 of that kind.

The transmitter units 40 are not necessarily connected with the elevator control device 16. However, in all cases the transmitter units 40 are spatially associated with the elevator installation 10 and, for example, mounted in the vicinity of the floor doors (at the walls or at the floor ceiling). The transmitter units 40 permanently transmit, thus regularly at predetermined or predeterminable intervals, for example every second, a floor-specific identification code 42 in the form of a so-called broadcast. Because the identification code 42 is transmitted as a broadcast, every mobile radio 24 present in the transmission range of a transmitter unit 40 can receive the identification code 42. The range of the transmitter units 40 is in the region of 4 to 10 meters depending on the respective requirements. In the case of other building topologies, thus particularly in the case of especially large buildings, a greater range can also be provided as long as it is guaranteed that an identification code 42 transmitted by a transmitter unit 40 of a first floor 18 can be received only on this floor 18 and not also on another floor 18. The transmitter units 40 transmit the identification code 42 by means of WLAN, WiFi, WPNA, by way of Bluetooth or ZigBee or according to methods which are known or become known in the future for data transmission between apparatus over a short distance by radio. In principle, data transmission according to the NFC standard is also conceivable.

If the transmitter units 40 are in communicating connection with the elevator control device 16 by line coupling or line-free coupling there is the possibility of using a variable identification code 42 predetermined or at least influenced by the elevator control device 16. In this way, a user can obtain on his or her mobile radio 24 in the context of receipt of an identification code 42 additional data about the elevator installation 10, for example information whether a specific elevator is out of operation. If the transmitter units 40 are independent of the elevator control device 16, these transmit a predetermined or predeterminable identification code 42 which, for example, is settable in each transmitter unit 40 either in the context of programming or, for example, by way of so-called DIP switches or the like.

Figure 4:
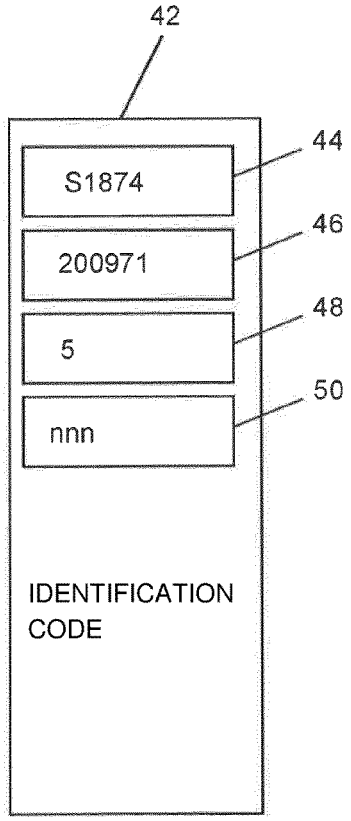

The illustration in FIG. 4 shows one possible layout of the floor-specific identification code 42 and individual items of data included in the identification code 42 in correspondence with the approach proposed here. Belonging to these data are an identification code prefix 44, an elevator installation identifier 46 uniquely identifying the respective elevator installation 10, a floor designator 48 and an optional transmission authentication code or message authentication code 50 provided for safeguarding the identification code 42 against falsification.

The floor designator 48 comprises either the respective floor number or a coded form of the floor number. Due to the fact that the identification code 42 comprises the floor designator 48, the identification code 42 is floor-specific. In the case of the situation shown in FIG. 4, the identification code 42 is floor-specific and elevator-installation-specific because it includes, apart from the floor designator, also the elevator installation identifier 46.

The respective value of the message authentication code 50 is determined by the transmitter unit 40 in correspondence with an algorithm implemented in the transmitter unit 40, for example as a coded hash message authentication code (HMAC).

As soon as the user enters, by his or her mobile radio 24, the transmission range of a transmitter unit 40 the mobile radio receives an identification code 42 transmitted as a broadcast by the respective transmitter unit 40.

Figure 5:
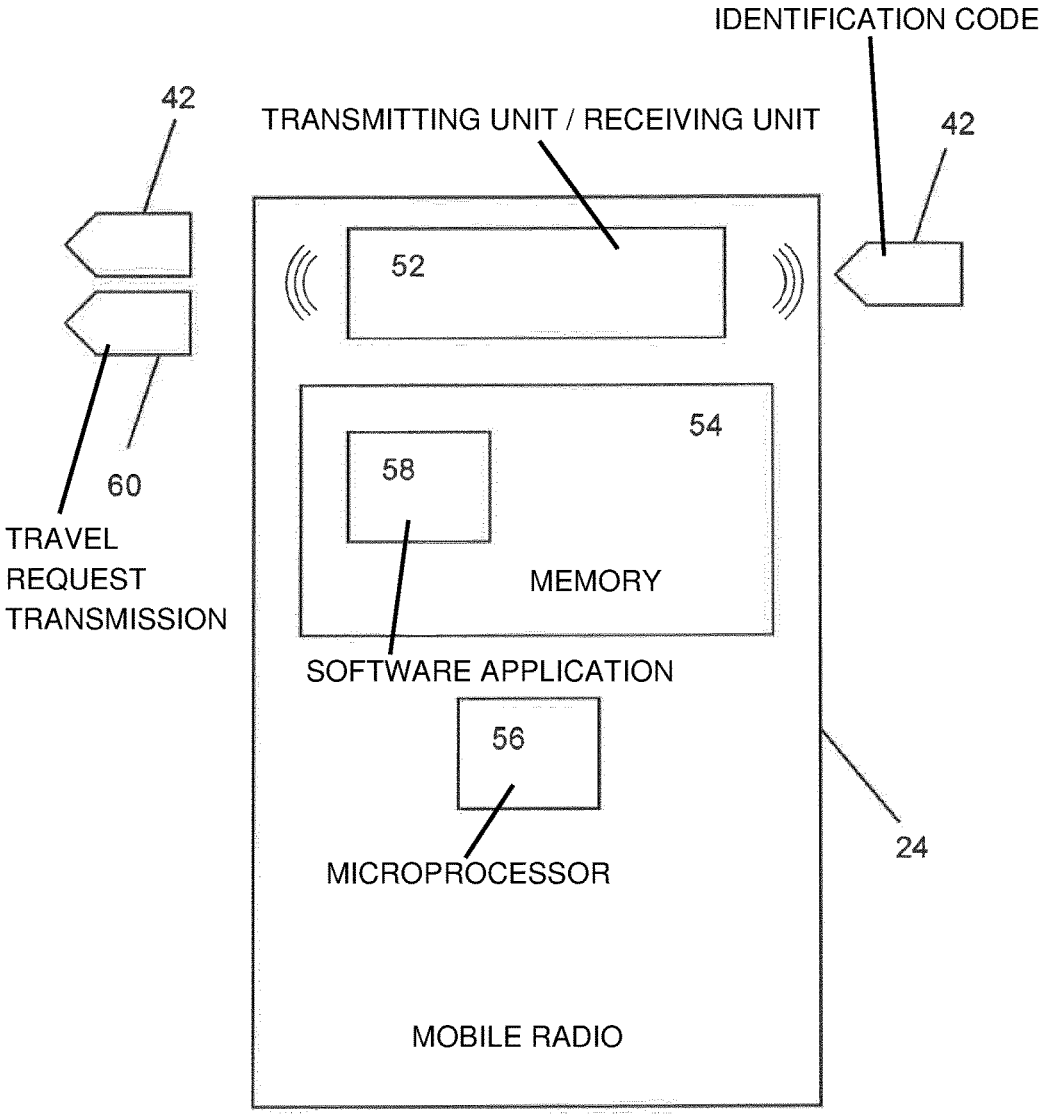
FIG. 5 shows a schematic simplified illustration of a mobile radio with a software application loaded into the memory thereof for execution of the method described here.

The illustration in FIG. 5 shows for that purpose the mobile radio 24 with further details insofar as these are of significance for explanation of the approach proposed here. Accordingly, the mobile radio 24 comprises in a mode and manner known per se a transmitting and receiving unit 52, a memory 54 and a processing unit in the form of or of such a kind as a microprocessor 56. The transmitting and receiving unit 52 is here shown—schematically simplified—as a single functional unit. The transmitting and receiving unit 52 is arranged in any case for the purpose of transmitting and receiving data in accordance with the respective mobile radio standard as well as receiving data from the transmitter units 40 in accordance with the respective data transmission method used by these. To that extent an actual implementation of such a transmitting and receiving unit 52 can comprise a plurality of functional units, thus, for example, a functional unit for transmitting and receiving data in accordance with the respective mobile radio standard and one or more further functional units for transmitting and receiving Bluetooth data, ZigBee data, etc.

An identification code 42 received by a transmitting unit 40 is evaluated by a software application 58 loaded in the memory 54 of the mobile radio 24 in a mode and manner known per se. The software application 58 is, in a mode and manner known per se, a computer program with program code instructions included therein. Under control of the software application 58, the mobile radio 24 transmits the received identification code 42 to the server 28 via the respective mobile radio network and the internet 26. The server 28, thus a server program running at the server, checks whether the thus-received identification code 42 is valid. For that purpose, at least the identification code prefix 44 and the message authentication code 50 are evaluated. The identification code prefix 44 respectively included in the identification code 42 can largely be selected as desired at the time of programming or configuration of the transmitting units 40 and shall at least ensure that the server 28 recognizes an identification code 42 entering thereat as relevant use data and these are distinguishable from other use data which in particular circumstances similarly enter the server 28.

On receipt of a valid identification code 42 the server 28 transmits the associated elevator-specific data back to the respective mobile radio 24. For that purpose, the server compares the elevator installation identifier 46 included in the identification code 42 with the elevator installation identifier 32 of the elevator installation data sets 30 filed in its memory. As soon as a match is made, the data included in the respective elevator installation data set 30 or also the elevator installation data set 30 overall can be transferred as elevator-specific data to the mobile radio 24.

The server 28 thus comprises means for retrievable storage of at least one elevator installation data set 30 received by an elevator control device 16, means for determining an elevator installation data set 30 matching a received identification code 42, and means for transmitting such a matching elevator installation data set 30 to a mobile radio 24. The means for retrievable storage of one or more elevator installation data sets 30 can be a memory in the form of a hardware memory and/or in the form of usual memory devices (hard discs and the like) as well as a software functionality for management of the memory content and for access to the memory content. The means for determining an elevator installation data set 30 matching a received identification code 42 can be a software functionality which runs at the server 28 and is intended and arranged for comparison of the elevator installation identifier 46—which is included in the identification code 42—with the elevator installation identifier 32 of the or each elevator installation data set 30 stored at the server 28. For transmission of such a matching elevator installation data set 30 to the respective mobile radio 24 the server 28 is connected with, for example, the internet 26 and by way of the internet 26 with the mobile radio network in which the mobile radio 24 is reachable.

For simplification of the further description and the illustration in FIG. 2 it is assumed that the server 28 communicates to the mobile radio 24 on a valid identification code 42, which is obtained from a mobile radio 24, the respectively associated original elevator installation data set 30 obtained from the elevator control device 16. It can obviously also be provided here that only the still relevant data of the elevator installation data set 30, thus, for example, not the elevator installation identifier 32, are communicated to the mobile radio 24. Moreover, the data actually communicated to the mobile radio can also comprise additional data and accordingly extend beyond the data of the original elevator installation data set 30. All this is to be comprehended by the use of the term elevator installation data set 30, insofar as there is meant an elevator installation data set 30 communicated by the server 28 to the mobile radio 24, and accordingly is to be read into this at all times.

The data communicated in the form of the elevator installation data set 30 from the server 28 to the mobile radio 24 can also be filtered at the server 28 on the basis of the floor designator 48 included in the identification code 42, for example if in the case of an elevator installation 10 with a plurality of elevator cars 14 individual elevator cars 14 are not usable at the floor 18 which is designated by the floor designator 48 and on which the user is currently present. Moreover, under control of the software application 58 and after receipt of the elevator installation data set 30 from the server 28 the floor 18 on which the user is present can be displayed on the display (image screen) of the mobile radio 24. Such a display is in principle possible—similarly under the control of the software application 58—already after receipt of the identification code 42 from one of the transmitter units 40. If the display of the floor number on the display of the mobile radio 24 takes place only on receipt of the elevator installation data 30 from the server 28 the displaying of the floor number on the display of the mobile radio 24 is already a report to the user that a successful communication with the elevator installation 10 has taken place.

The user now has the possibility by means of his or her mobile radio 24 and the software application 58 running thereon to undertake control actions with respect to the elevator installation 10. Such a control action is, for example, a travel request. If by means of the software application 58 the user inputs a travel request, for example from the floor with the number 5 (starting floor) to the floor with the number 2 (destination floor), a travel request transmission 60 automatically generated by the software application 58 on the basis of this travel request (FIG. 5, FIG. 6; first travel request transmission 60) is transmitted to the server 28.

Figure 6:
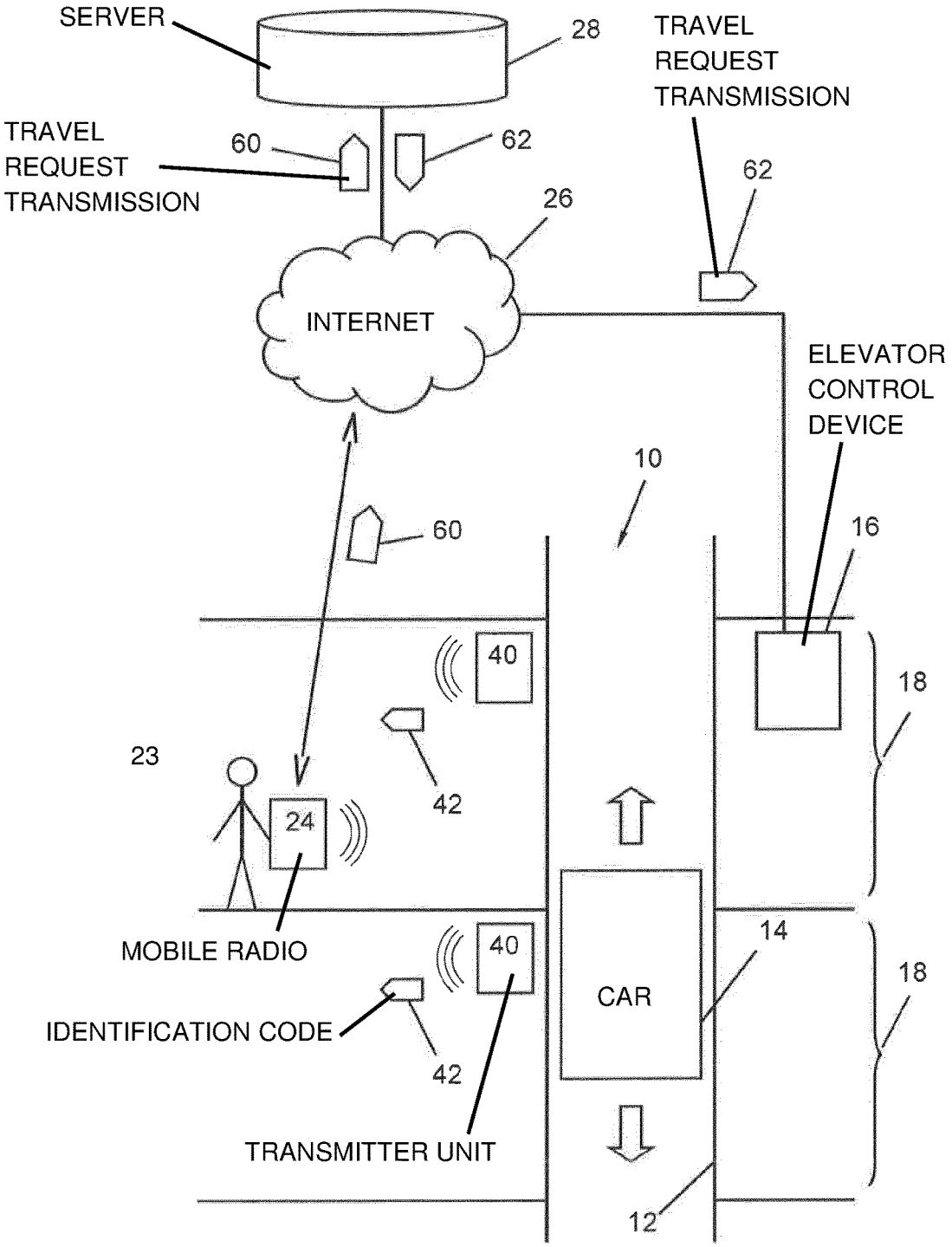
FIG. 6 shows the elevator installation as in FIG. 2 with a schematic simplified illustration of further communications procedures taking place in the context of the method presented here.

The illustration in FIG. 6 shows that the server 28 after receipt of such a travel request transmission 60 for its part transmits a corresponding travel request transmission 62 (second travel request transmission 62) to the elevator control device 16.

To that extent, the server 28 comprises means for receiving and transmitting such travel request transmissions 60, 62. For that purpose, the server 28 is, for example, connected with the internet 26 in a mode and manner known per se, wherein the travel request transmission 60 originating from the mobile radio 24 is initially communicated by way of the respective mobile radio network to the internet 26 and passed by means of the internet 26 to the server 28 and wherein the travel request transmission 62 transmitted by the server 28 passes by way of the internet 26 to the elevator control device 16.

Figure 7:
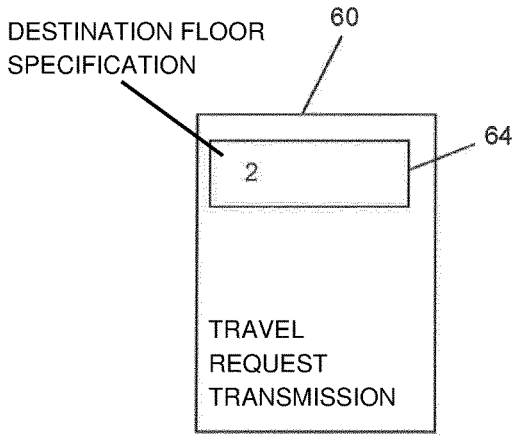
FIGS. 7, 8 show one possible layout of two data transmissions communicated in the context of the communications procedures shown in FIG. 6, namely a travel request transmission transmitted by the mobile radio and a travel request transmission received at the side of the elevator installation.
Figure 8:
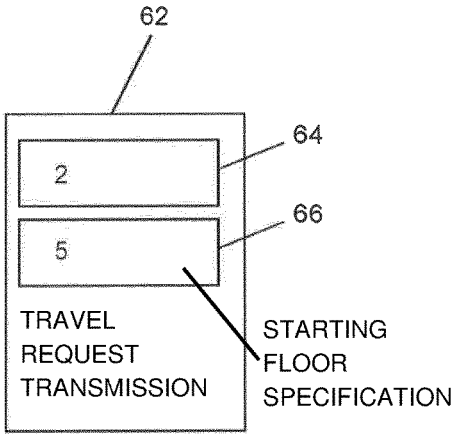

The illustrations in FIG. 7 and FIG. 8 show in schematic, simplified form one possible layout of such travel request transmissions 60, 62. The travel request transmission 60 transmitted by the mobile radio 24 to the server 28 comprises at least a specification of the respective destination floor (destination floor specification 64). A specification of the respective destination floor is in principle sufficient here because the starting floor, thus the floor on which the user is present, is already known at the server 28 from the preceding communication of the identification code 42. The travel request transmission 62 transmitted by the server 28 to the elevator control device 16 comprises at least a specification of the respective starting floor (starting floor specification 66) as well as the respective destination floor specification 64.

The elevator control device 16 executes in due course the journey specified in this way by means of the travel request transmission 62, i.e. the elevator control device 16 moves the elevator car 14 to the floor 18 on which the user is present and conveys the user, after boarding the elevator car 14, to the destination floor. When the elevator control device 16 can execute the travel request corresponding with the travel request transmission 62 it is preferably provided—but in principle optional—that the elevator control device 16 automatically generates an acknowledgement transmission (not shown) and transmits it to the server 28. The server 28 returns such an acknowledgement transmission to that mobile radio 24 which has triggered the travel request on which the travel request transmission 62 is based. In this way, the user can be informed by way of the user interface of the software application 58 of his or her mobile radio 24 that his or her travel request can now be fulfilled. The data transmissible in this way to the mobile radio 24 can, however, also emanate from a simple readiness report and, for example, can comprise data about which elevator car 14 shall complete the travel request so that by means of the user interface of the software application 58 it is indicated to the user which elevator car 14 is to be used.

It can be provided for the data transmissions exchanged between the mobile radio 24 and the server 28 on the one hand and the server 28 and the elevator control device 16 on the other hand, thus in particular the travel request transmissions 60, 62, that these each comprise an identifier in the manner of the elevator installation identifier 32, 46 and/or are secured in another mode and manner.

In use of a method in accordance with the approach proposed here in railway stations, shopping centers, parking garages, apartment blocks and the like there is no communication, in the context of communication of the travel request transmissions 60, 62, of a user identifier identifying the respective user. This is nevertheless possible in special use situations and is embraced by the approach proposed here. It can then be additionally checked, for example, in an elevator installation 10 with access control whether the user is authorized for the requested journey. In a given case the travel request is then refused. There is then no communication of a travel request transmission 62 to the elevator control device 16. A report in the form of a data transmission, which appropriately informs the user, can optionally be automatically transmitted by the server 28 to the requesting mobile radio 24. Additionally or alternatively it can be provided that floors 18 which need special authorization are not even displayed by the software application 58 of the mobile radio 24 if a user identifier connected with a corresponding authorization for individual or all floors 18 is not transmitted by means of the travel request transmission 60 or in conjunction with the communication of the travel request transmission 60. Such a restricted display of specific floors 18 by the user interface represented by the software application 58 can be ensured by communication of appropriately restricted data from the server 28 to the software application 58 of the mobile radio 24, for example in that the server 28 communicates to the mobile radio 24 in a response transmission (not shown) on receipt of the travel request transmission 60 a list with the floors 18 accessible in correspondence with the communicated user identifier. Accessible and non-accessible floors 18 as well as optionally an authorization, which is necessary for a floor 18 not accessible without further measures, and the like can be filed at the server 28 in the database thereof and/or conjunctively notified to the server 28 by the elevator control device 16 with the elevator installation data set 30 or in connection with the communication of the elevator installation data set 30.

The software application 58 can also graphically represent accessibility or non-accessibility to individual floors 18, for example in that only those floors 18 which can be travelled to by the user are displayed, for example, by the respective number thereof. Additionally or alternatively, by means of a user interface illustrated by the software application 58 it is possible for floor buttons or the like to appear in an active or an inactive form and/or be colored (for example green=accessible, red=blocked) and/or characterized by a readily understandable symbol (for example lock with closed yoke=blocked, lock with open yoke or illustration without such a symbol=accessible).

The communicating connection between the server 28 and the elevator control device 16 is preferably designed, but in basically optional mode and manner, to be particularly secure. Coming into consideration here are coding and securing mechanisms known per se for securing the communication between the server 28 and the elevator control device 16, for example SSL, TSL, HTTPS, VPN and the like.

The software application 58 makes possible—in a preferred, but basically optional, design—use of predetermined or predeterminable user profiles downloaded into the memory 54 of the mobile radio 24. A user profile can be directed to, for example, the requirement for an elevator car 14 appropriate to handicapped persons, to the requirement for a VIP elevator car 14, to longer opening times of the floor and car doors, to an optical and/or acoustic playing of special media and the like in the elevator car 14, etc. On the basis of such a user profile appropriate data are transmitted to the server 28, for example as a component of the travel request transmission 60, in connection with a travel request by the user by means of the software application 58. The server 28 checks the thus-obtained data and passes on these, for example as additional use data in the travel request transmission 62, to the elevator control device 16. Additionally or alternatively to such user profiles the software application 58 can offer, together with a specification of a travel request, thus at least the selection of a destination floor, further selection options by means of the user interface so that the user can more precisely formulate or additionally parameterize the respective travel request. It is thus possible, for example, for the user in order to fulfill his or her travel request to require a car appropriate to a handicapped person and/or for the user to book playing of a specific audio and/or video sequence for his or her travel request.

The specification of a travel request can also be undertaken by the user before he or she is physically in the vicinity of the elevator installation 10. The user then undertakes specification of the respective destination floor, for example, when he or she is still present at his or her workplace and selects as destination floor, for example, the floor in which an underground garage is present. As soon as the user leaves his or her workplace and comes by his or her mobile radio 24 into the transmission range of a transmitting unit 40 the above-described data exchange with the server 28 and the elevator control device 16 takes place, in which case it is recognized on the part of the software application 58 running on the mobile radio 24 that a travel request is already present and the software application 58 accordingly automatically generates a travel request transmission 60 as soon as the identification code 42 has been received by a transmitter unit 40 and thus the data necessary for communication with a server 28 are present. In other words, the user can file a generic travel request in the mobile radio 24, which is communicated to the remote server 28 as soon as the mobile radio 24 comes into the receiving range of any, in particular undefined beforehand, transmitting unit 40. The starting floor can thus be dynamically determined by the identification code first received after activation of the generic travel request. Activation of the generic travel request can also take place on a time basis, for example every working day around 17.00 hours, and/or on a positional basis, for example by means of approach to the GPS position of the elevator location.

Figure 9:
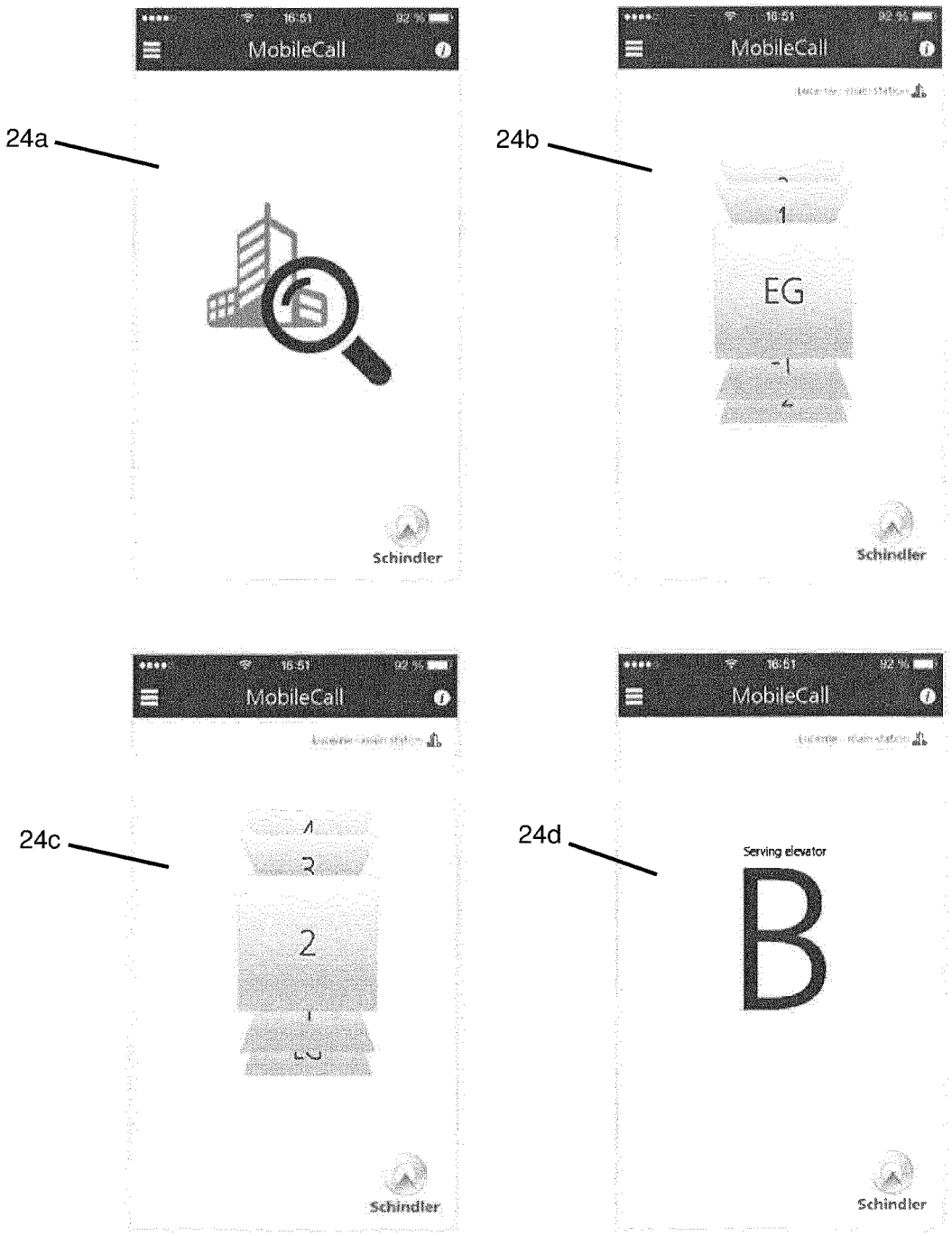
FIG. 9 shows individual so-called screenshots of a user interface, which is represented on the display of a mobile radio, in connection with use of the approach described here.

Finally, the illustration in FIG. 9 shows from left to right snapshots of the user interface, which is represented by the software application 58 on the display of the mobile radio 24, in the case of use of the mobile radio 24 in the context of the approach described here.

The illustration at the top left (display 24*a*) is one possibility for a representation such as is carried out when the mobile radio 24 is outside the transmission range of at least one transmitting unit 40. The software application 58 then seeks, so to speak, a building in which there is an elevator installation 10 to which access is possible in the above-described mode and manner by means of the software application 58.

In the case of the illustration at the top right (display 24*b*) the software application 58 has received an identification code 42 from a transmitting unit 40 and in a given case has also already communicated this to the remote server 28 as well as received therefrom the elevator installation data set 30. A plain-text display of a designation of a respective building, here "Lucerne—Main Station", can in principle take place already by virtue of the receipt of the identification code 42 by a transmitting unit 40. Equally, a representation of the respective floor 18 on which the user together with his or her mobile radio 24 is present, here "EG" for ground floor, can already take place by virtue of the receipt of the identification code 42.

Preferably, but in principle optionally, it is provided that such displays take place only when the software application 58 has obtained the elevator installation data set 30 from the server 28. It is then guaranteed that the server 28 has checked the communicated identification code 42 and that the identification code 42 is a permissible identification code 42.

The illustration at the bottom left (display 24*c*) is one possibility for design of the user interface for selection of the destination floor by the user. The software application 58 generates the travel request transmission 60 on the basis of such a selection.

Finally, the illustration at the bottom right (display 24*d*) shows one possibility for design of the user interface for displaying that the travel request registered by the user can now be fulfilled and in the illustrated example also comprises information with respect to the elevator car 14 to be used, here an elevator car 14 denoted by the letter "B".

Although the invention has been more specifically illustrated and described in detail by the embodiment, the invention is not limited by the disclosed example or examples and other variations can be derived by the expert without departing from the scope of protection of the invention.

Individual aspects, which are to the forefront, of the description filed here can thus be summarized briefly as follows: A method of operating an elevator installation 10, an elevator control device 16 and mobile radio 24 for carrying out the method as well as a system with such an elevator control device 16 and mobile radio 24 are indicated, wherein the control actions with respect to the elevator installation 10 can be undertaken by means of the mobile radio 24 and wherein the mobile radio 24 obtains relevant data, which enable immediate access to the elevator installation 10, initially in the form of an identification code 42 transmitted continuously or regularly by a transmitter unit 40 associated with the elevator installation 10.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method of operating an elevator installation, the elevator installation having a respective transmitter unit arranged at each of a plurality of floors reachable by the elevator installation, comprising the steps of:

transmitting from each of the transmitter units a floor-specific identification code representing one of the floors at which the transmitter unit is arranged;

receiving one of the identification codes with a mobile radio when the mobile radio is present in a transmission range of the transmitter unit transmitting the one identification code;

specifying in a travel wish for use of the elevator installation by a software application running on the mobile radio;

transmitting the travel wish as a first travel request transmission to a server being remote from the elevator installation using the one identification code; and the server responding to the first travel request transmission by passing on the travel wish in the form of a second travel request transmission to the elevator installation;

wherein:

the one identification code comprises at least one elevator installation identifier;

the elevator installation transmits to the server an elevator installation data set including elevator-installation-specific data as well as the at least one elevator installation identifier, the elevator-installation-specific data including a number of floors, a number of elevator cars, and a control type encoding a functionality of an elevator control device of the elevator installation; and the software application running on the mobile radio transmits the one identification code to the server; and the server responds to receipt of the one identification code by searching, based on the at least one elevator installation identifier included in the one identification code, for the elevator installation data set with a matching one elevator installation identifier and transmits the elevator installation data set to the mobile radio.

2. The method according to claim 1 wherein at least individual items of data included in at least one of the identification code and the elevator installation data set are displayed at the mobile radio by a user interface generated by the software application.

3. The method according to claim 1 wherein the identification code includes an identification code prefix.

4. The method according to claim 1 wherein the identification code includes a message authentication code.

5. The method according to claim 4 wherein the message authentication code is an encoded hash message authentication code.

6. An elevator control device for at least one of controlling and monitoring an elevator installation, the elevator control device adapted to perform the method according to claim 1 by transmitting an elevator installation data set to the server and receiving from the server the second travel request transmission.

7. A system for operating an elevator installation, the elevator installation including an elevator control device for at least one of controlling and monitoring the elevator installation, comprising:

a mobile radio;

a server remote from the elevator installation and in communication with the elevator control device and the mobile radio; and a respective transmitter unit at each of a plurality of floors reachable by the elevator installation, wherein the elevator control device transmits an elevator installation data set to the server and receives a travel request transmission from the server, the elevator installation data set including elevator-installation-specific data as well as at least one elevator installation identifier, the elevator-installation-specific data including a floor number of floors, a number of elevator cars, and a control type encoding a functionality of an elevator control device of the elevator installation, wherein each of the transmitter units transmits a floor-specific identification code, and wherein the server includes a memory for retrievable storage of the elevator installation data set received from the elevator control device, a microprocessor running a software application for determining whether the elevator installation data set matches an identification code received from the mobile radio, and a transmitting unit for transmitting the elevator installation data set to the mobile radio when the identification code is matched.

8. The system according to claim 7 wherein at least individual items of data included in the identification code and the elevator installation data set are displayed at the mobile radio by a user interface generated by the running software application.

9. The system according to claim 7 wherein the identification code includes an identification code prefix.

10. The system according to claim 7 wherein the identification code includes a message authentication code.

11. The system according to claim 10 wherein the message authentication code is an encoded hash message authentication code.

12. The method according to claim 1, wherein transmitting the travel wish as the first travel request transmission to the server being remote from the elevator installation using the one identification code includes transmitting the first travel request transmission through the internet; and the server responding to the first travel request transmission by passing on the travel wish in the form of the second travel request transmission to the elevator installation includes transmitting the second travel request transmission through the internet.

13. The method according to claim 6, wherein the elevator control device automatically generates an acknowledgement transmission and transmits it to the server and the server transmits the acknowledgement transmission to the mobile radio, thereby providing an indication that the travel wish can be fulfilled.

14. The method according to claim 1 wherein the control type included in the elevator-installation-specific data is one of a conventional control, a group control, a destination call control and a control with special functions.

15. The system according to claim 7 wherein the control type included in the elevator-installation-specific data is one of a conventional control, a group control, a destination call control and a control with special functions.

16. A method of operating an elevator installation, said method comprising:

providing a transmitter unit arranged at each of a plurality of floors reachable by the elevator installation;

transmitting, by the elevator installation, to a server remote from the elevator installation, an elevator installation data set including elevator-installation-specific data comprising an elevator installation identifier, a number of floors, a number of elevator cars, and a control type;

transmitting from each of the transmitter units a floor-specific identification code representing one of the floors at which the transmitter unit is arranged;

receiving one of the identification codes by a mobile radio when the mobile radio is present in a transmission range of the transmitter unit;

transmitting to the server, by the mobile radio, the received identification code;

comparing, by the server, an elevator installation identifier contained in the received identification code to elevator installation data sets in memory to identify the elevator installation associated with the received identification code;

transmitting to the mobile radio, by the server, the elevator-installation-specific data for the elevator installation;

presenting to a user by a software application running on the mobile radio, a present floor and available destination floors, based on the identification code and the elevator-installation-specific data;

specifying a travel wish including a desired destination floor, by the user using the software application on the mobile radio;

transmitting to the server, by the mobile radio, a first travel request transmission including the desired destination floor;

transmitting to the elevator installation, by the server, a second travel request transmission including the present floor and the desired destination floor;

fulfilling the travel wish, by the elevator installation, including moving an elevator car to the present floor and sending an acknowledgement to the server;

transmitting the acknowledgement to the mobile radio by the server; and displaying an impending arrival of the elevator car at the present floor by the software application on the mobile radio.

* * * * *